US005425130A

United States Patent [19]

Morgan

[11] Patent Number: 5,425,130

[45] Date of Patent: Jun. 13, 1995

[54] APPARATUS FOR TRANSFORMING VOICE USING NEURAL NETWORKS

[75] Inventor: David P. Morgan, No. Chelmsford, Mass.

[73] Assignee: Lockheed Sanders, Inc., Nashua, N.H.

[21] Appl. No.: 48,627

[22] Filed: Apr. 16, 1993

Related U.S. Application Data

[63] Continuation-in-part of Ser. No. 908,585, Jun. 29, 1992, abandoned, which is a continuation of Ser. No. 552,679, Jul. 11, 1990, abandoned.

[51] Int. Cl.[6] ..... G10L 9/00

[52] U.S. Cl. ..... 395/2.79; 395/2.11; 395/2.68

[58] Field of Search ..... 381/51; 395/2.1, 2.11, 395/2.67, 2.68, 2.79, 2.78

[56] References Cited

U.S. PATENT DOCUMENTS 3,982,070 9/1976 Flanagan ..... 395/2.78
4,788,649 11/1988 Shea et al. ..... 395/2.79
5,278,943 1/1994 Gasper et al. ..... 395/2

*Primary Examiner*—Allen R. MacDonald
*Assistant Examiner*—Michelle Doerrler
*Attorney, Agent, or Firm*—David W. Gomes

[57] ABSTRACT

An apparatus for transforming a voice signal of a talker into a voice signal having characteristics of a different person provides apparatus for separating the talker's voice signal into a plurality of voice parameters including frequency components, a neural network for transforming at least some of the separated frequency components into those characteristic of the different person, and apparatus for combining the voice parameters for reconstituting the talker's voice signal having characteristics of the different person.

17 Claims, 3 Drawing Sheets

APPARATUS FOR TRANSFORMING VOICE USING NEURAL NETWORKS

This is a continuation-in-part of application Ser. No. 07/908,585, filed Jun. 29, 1992, and now abandoned, which application was a continuation of application Ser. No. 07/552,679, filed Jul. 11, 1990, and now abandoned.

FIELD OF THE INVENTION

The present invention generally relates to voice modeling and, in particular, to the use of voice models for transforming the voice of one person into the voice of another person.

BACKGROUND OF THE INVENTION

Voice modeling has been an active field for some years for various purposes related to voice communications. Voice modeling typically decomposes voice signals into parameters which require less storage and bandwidth capacity for transmission. The resulting voice compression facilitates greater efficiency and more secure voice communications.

One of the voice models previously developed is referred to as the multiband excitation (MBE) model. This model takes discrete time intervals of a voice signal and separates each into the parameters of pitch, harmonic band energy, and the voiced or unvoiced state of each of the harmonic bands. Pitch is defined as the vibration frequency at the glottis, which excites the vocal tract to produce different sounds. The specific number of harmonic bands depends upon the pitch frequency and the bandwidth of the audible voice produced therefrom. Normally voice bandwidths up to 5 kHz are common because energy levels at higher frequencies drop off substantially. For this reason, voice models have typically been developed which function for bandwidths between 3.6 to 5.0 kHz. The voiced and unvoiced state of each of the harmonic bands is defined as the respective presence or absence of structured (non-Gausian) energy in the band. The voice model mentioned above is explained in greater detail in "Multiband Excitation Vocoder", Ph.D. Dissertation, Daniel W. Griffin, M.I.T. 1987.

Another area of interest for the application of voice modeling is that of synthesizing a person's voice via the transformation of the voice of a first talker into the voice of a different person or second talker. Whereas the MBE model compresses the amount of information required for the storage and transmission of voice signals, voice transformation takes the parameters estimated from one person's voice and transforms them to have the characteristics of another person's voice. The intent is to make the first talker sound like the second talker.

SUMMARY OF THE INVENTION

The present invention provides an apparatus for transforming the voice of one person into that of another person through the use of advances made in the area of voice modeling and nonlinear transformation techniques. The apparatus provides means for separating a voice signal of someone such as a talker into a plurality of voice parameters including frequency components, neural network means for transforming at least some of the separated frequency components from having characteristics of the talker into having characteristics of the different person, and means for combining the voice parameters after transformation of some of the frequency components by the neural network means for reconstituting the talker's voice signal having characteristics of the different person. A refinement of the invention includes means for extracting pitch data and the frequency components of harmonic band energy data related to the pitch. A further refinement includes means for interpolating the harmonic band energy data into a predetermined number of frequency bands.

BRIEF DESCRIPTION OF THE DRAWINGS

The present invention is illustratively described in reference to the appended drawings of which.

DETAILED DESCRIPTION OF THE DRAWINGS

Figure 1:
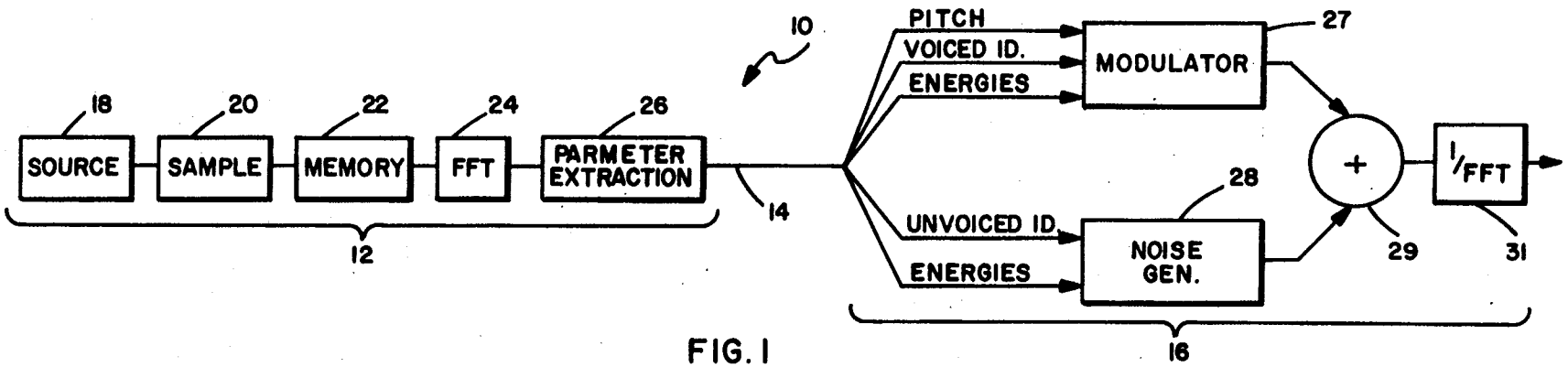
FIG. 1 (PRIOR ART)
FIG. 1 is a block diagram of a voice modeling technique known in the prior art.

FIG. 1 shows a block diagram of a system 10 generally configured in accordance with the prior art for the use of the multiband excitation voice modeling technique in the compression, transmission and resynthesis of voice signals. The system 10 generally includes an analysis section 12, a transmission line 14 and a synthesis section 16.

Within the analysis section 12, a voice signal source 18 is coupled to a digital sampling system 20 which would typically digitize the voice signal at a rate of 10,000 samples per second and with a resolution of approximately fourteen (14) binary bits. The digitized voice signal is stored in a memory 22 where it may be randomly accessed for processing. The digitized data is recovered from memory 22 as a series of processing blocks or discrete time intervals of the voice signal. In accordance with one technique, 256 samples, representing a time interval of 25.6 ms (milliseconds) at the 10 kHz sampling rate, constitute each of the sampling blocks. Sequential intervals are time shifted by only 128 samples, or one half of the interval, in order to provide an overlap of the data between processing blocks and additional continuity to the processing. The blocks of data are coupled to means for performing a Fast Fourier transform 24 which converts the digitized voice signal from the time domain into the frequency domain for each of the time intervals of data.

The frequency domain data is then analyzed in section 26 for determination of the parameters of pitch, harmonic energy data, and the voiced versus unvoiced state of each harmonic energy band. The extracted pitch represents the excitation signal produced by the glottis. The levels of the harmonic energy are evaluated for each of the harmonic bands produced from the pitch frequency. Determinations are also made as to whether each of the harmonic bands is either voiced or unvoiced. Voiced harmonic bands are those harmonic bands which contain structured, non-Gausian energy, while unvoiced bands are those harmonic bands which contain only Gausian energy or noise. By examining the error which results from the fitting of a parabola to each harmonic band, the voiced/unvoiced decision can be made. Low error indicates structured energy and a voiced state, while high error indicates the unstructured and unvoiced energy of noise. The low versus high decision is made based upon an arbitrary threshold level for the error such as 0.5 in a scale of 1.0 to 0. After the decision, a voiced/unvoiced identifier is typically quantized to either 1 or 0.

It is these voice parameters of pitch, harmonic band energy and voiced/unvoiced identifiers which may be transmitted by transmission line 14 or otherwise stored or handled with a data volume which is greatly reduced from the digitized data stored in memory 22.

When the compressed data is either received or withdrawn from storage, it is coupled to the synthesis section 16 and in particular the modulation section 27 and the noise generator 28. The pitch, the energy levels and voiced identifiers are coupled to the modulation section 27 which recreates the pitch for each time interval along with the voiced harmonic bands thereof. The energy band data and the unvoiced identifiers are coupled to noise generator 28 which resynthesizes the unvoiced energy bands of each time interval. The two resynthesized signals are coupled to a summation means 29 for producing the complete reconstituted signal. This signal is then reconverted into the time domain via an inverse Fast Fourier transform 31.

Figure 2:
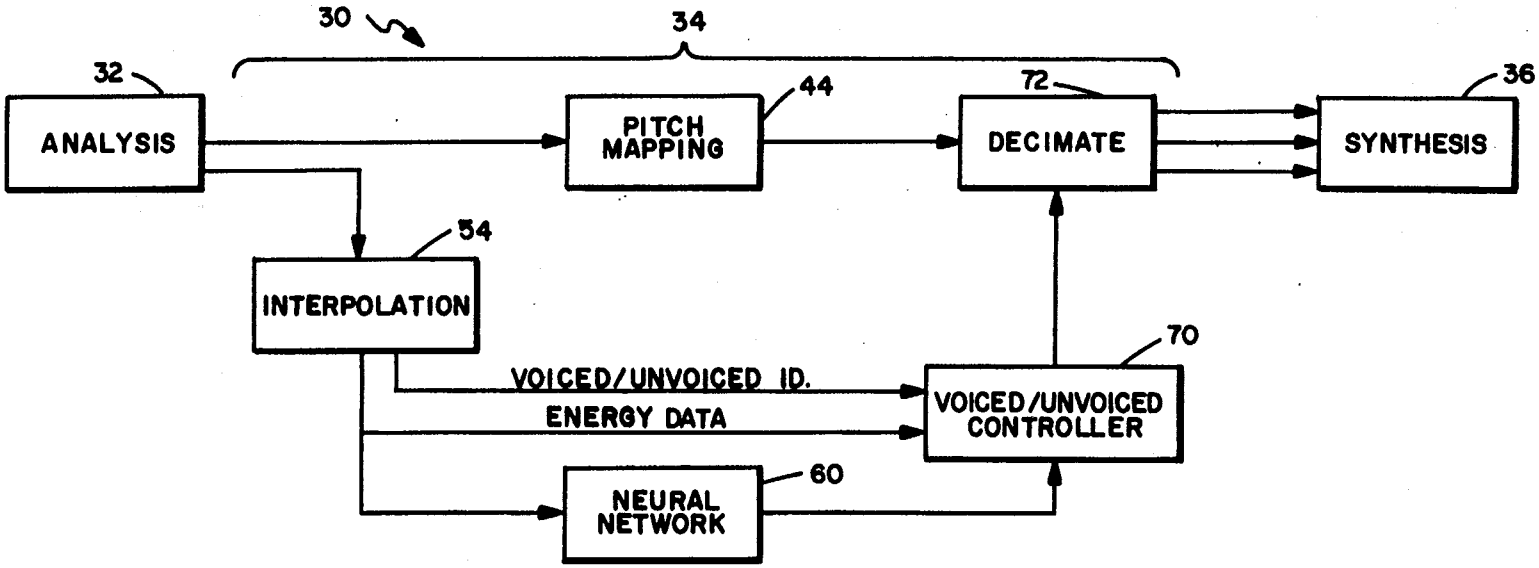
FIG. 2 is a block diagram of a voice transformation apparatus constructed in accordance with one embodiment of the present invention.

The above technique is used by one embodiment of the present invention as illustrated in FIG. 2, which includes an apparatus 30 for transforming the voice of one person such as a talker into that of a different person. Apparatus 30 generally includes an analysis section 32 for extracting parameters defined by a voice modeling technique from a voice signal, transformation section 34 for transforming the extracted parameters characterizing the talker's voice into parameters characterizing a different person's voice, and synthesis section 36 for reconstituting the transformed parameters into voice signals characteristic of the different person.

Figure 3:
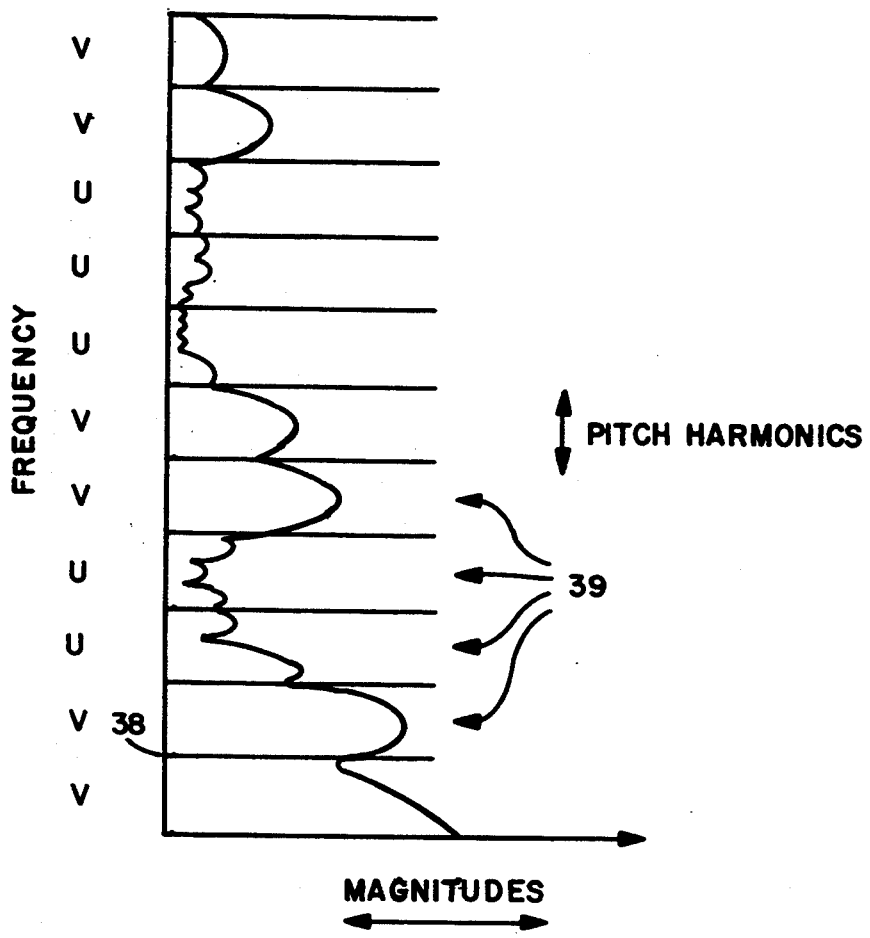
FIG. 3 is a graph of a voice signal interval represented in the frequency domain.

Analysis section 32 separates the voice signal into a plurality of voice parameters, one of which includes frequency components. This may be accomplished by various known techniques such as either the multiband excitation model described above, or by linear predictive coding. The present embodiment makes use of the MBE method and uses the same 10 kHz sampling rate as described above. The stored data is read from a memory as blocks of data representing discrete intervals of the voice signal. The blocks used are the same size of 256 voice samples as above; however instead of shifting the time interval by 12.8 ms (128 voice samples), a shift of only 10.0 ms (100 samples) is used. The data which is next extracted from the block is used to represent the 10 ms interval defined by the shift. The above blocks of data are coupled to means for performing a Fast Fourier transform as in 24 of FIG. 1, which converts the voice signal for each time interval into the frequency domain as represented by the graph of FIG. 3. As the data has been digitized and is processed digitally for the Fast Fourier transform, it is represented in the frequency spectrum of FIG. 3 as discrete digital energy values for different frequencies within the spectrum, for each 10 ms time interval.

The frequency spectrum for each interval is then analyzed to determine the pitch for that interval in the same manner as is typically performed for the MBE technique cited above. The determination made for the graph of FIG. 3 determines the basic pitch at the frequency 38, and on that basis, creates a plurality of harmonic bands which are all multiples of the pitch frequency 38. Once the frequency spectrum for the time interval represented is so divided into harmonic bands, the stored energy values become representative of the energy levels, for each of the harmonic bands.

An estimation is also made as to whether each of the harmonic bands is either voiced or unvoiced in the same manner as performed for the MBE model except that the specific amount of error is retained without being quantized.

Returning to FIG. 2, the extracted parameters are next coupled to the transformation section 34. The extracted pitch data is coupled to the pitch mapping section 44, where the pitch for each time interval of the voice signal is mapped from the pitch distribution of the first talker to that of the second talker. Because the harmonic band energy of a voice signal is dependent upon pitch, and pitch varies between speakers, voice transformation is more accurately accomplished when the pitch of one talker is shifted to the pitch of the other talker.

This shifting, or mapping, may be accomplished by means of determining a frequency distribution for both talkers. Once a sufficiently large number of intervals of a voice signal have been analyzed, a determination is made of the frequency distribution of the pitch. The mean value for that range and a standard deviation from that mean may then be used for specifying any single pitch sample.

Figure 4:
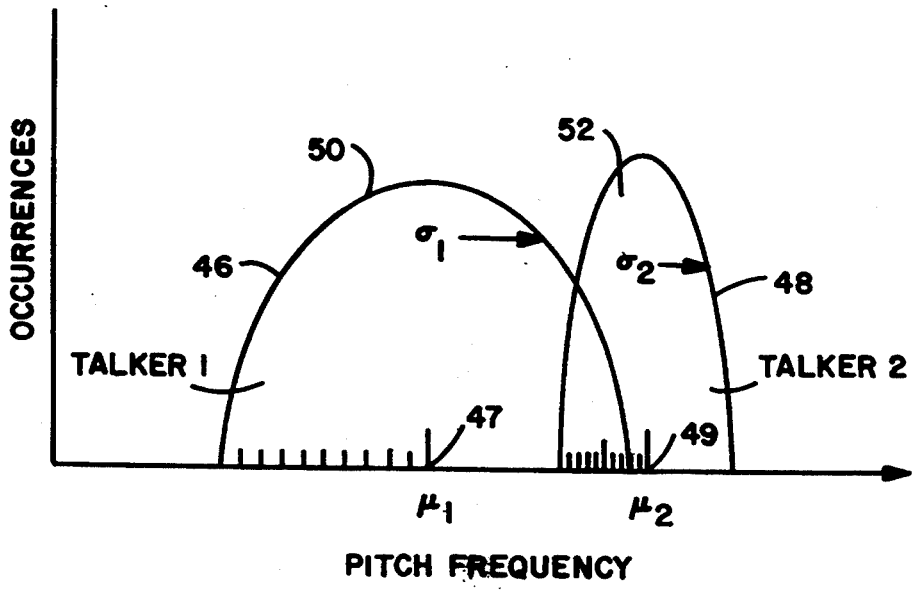
FIG. 4 is a graph of the frequency distribution of the pitch of each of two speakers.

FIG. 4 illustrates a pitch distribution showing the pitch frequency range 46, 48 for each of two talkers versus the number of occurrences in several voice signals. Each range 46, 48 is determined to have a mean pitch frequency 47, 49, respectively. The first talker is illustrated as having a broader range 46 and a lower mean pitch frequency 47 than the second talker. Next, a separate standard deviation is determined for each talker. For purposes of mapping, the pitch value for each interval of the first talker's voice signal is compared against the frequency distribution 47 and mapped to a corresponding position on the frequency distribution 49 of the second talker. For example, a specific pitch value 50 is compared to distribution 46 and determined to be located a total of three standard deviations below the mean pitch frequency 47. This pitch value 50 is then mapped to the frequency at point 52 representing 3 standard deviations below the mean pitch 49 of the target. This mapping is performed for each of the time intervals of the voice signal.

Returning to FIG. 2, as the pitch data of a voice signal is coupled to mapping section, the corresponding band energies and voiced/unvoiced identifiers are coupled to an interpolation section 54 wherein the energy values and the voiced/unvoiced identifiers are interpolated to a predetermined number of frequency bands. The present embodiment interpolates the energy data and identifiers to forty-eight (48) sequential energy bands of 83 Hz. to cover a frequency spectrum of approximately 4 kHz.

The energy data for the predetermined number of bands is coupled to a neural network 60 where it is transformed from the harmonic band energy data of the first talker into the harmonic band energy data of the second talker. The neural network 60 which is used is a back propagation trained, recurrent neural network which may be embodied by any suitable means. One embodiment uses a multilayer perceptron effected by software which is commercially available from Hect-Nielsen of San Diego, Calif., and is referred to as ANZA PLUS. This network is a back propagation trained network developed to run on an IBM PC or equivalent.

Figure 5:
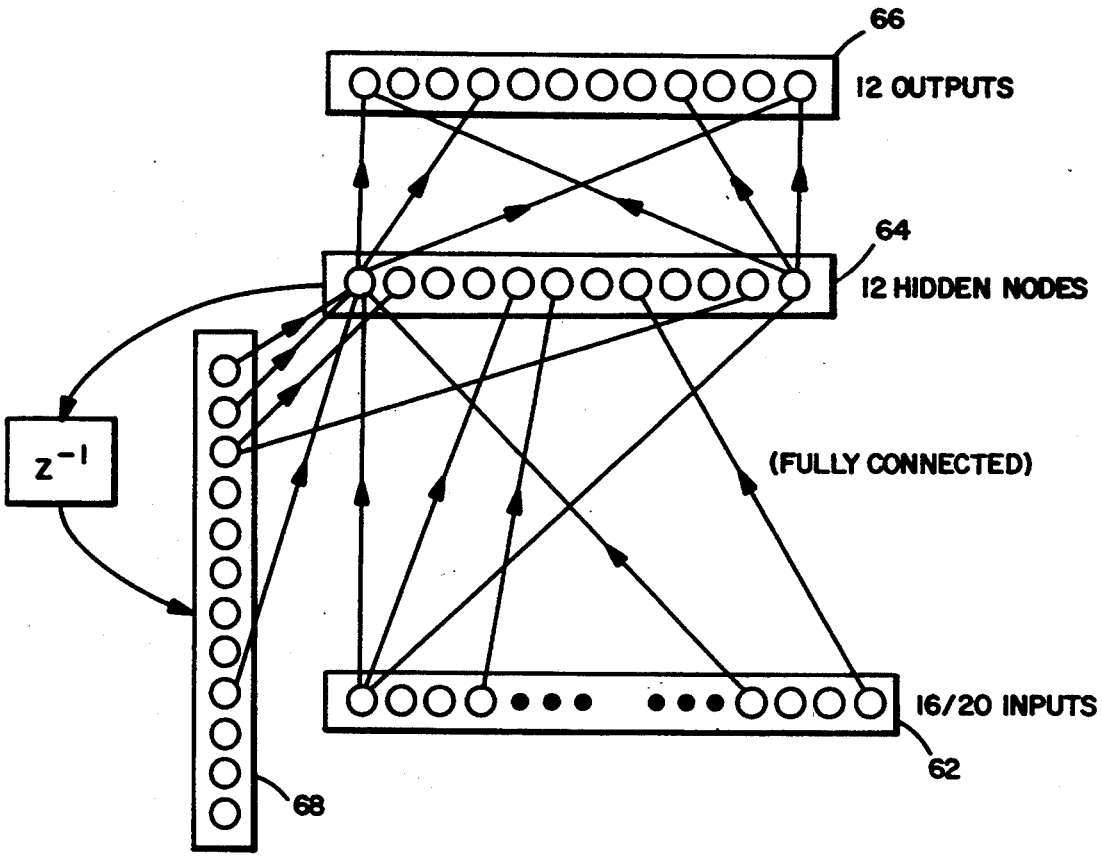
FIG. 5 is a representational diagram of a recurrent neural network used in the embodiment of FIG. 2.

The perceptron is diagrammed in FIG. 5 and includes 3 layers of nodes, an input layer 62, a hidden layer 64 and an output layer 66. Both the hidden and output layers are comprised of twelve nodes. The input layer 62 includes twenty direct input nodes and twelve pseudo nodes 68. The pseudo nodes 68 are program modifications of the commercially available product which give the perceptron its recurrent nature. The twelve pseudo nodes 68 each corresponds to a separate one of the twelve hidden nodes 64 and are each programmed to receive the energy state of a separate hidden node. Each of the direct input nodes 62 along with each of the pseudo nodes 68 is fully coupled to each of the twelve hidden nodes.

The neural network 60 so provided is used to process the energy data for the interpolated 48 frequency bands. This band energy is divided into four sets of twelve bands, each band is separately processed by the network 60 using additional frequency bands from adjacent sets. Thus, the sets of frequency bands at the top and bottom of the frequency spectrum are processed using four additional frequency bands from the adjacent set of bands and the middle two sets of frequency bands are processed using four additional frequency bands from each of the sets on both sides thereof. For this reason, the two middle sets of twelve frequency bands require twenty direct input nodes while the sets of frequency bands at the top and bottom of the frequency spectrum require only sixteen input nodes.

Prior to use in transforming harmonic band energy data, the neural network 60 must be trained. The standard training algorithm for a back propagation neural network includes inputting a sample to the network and comparing the output with the desired output. The input weights are then adjusted, one layer at a time starting with the output layer so that the actual output approximates the desired output as closely as possible. The weights are initially set at random values or at mid-range and adjusted from there. Repetitions of the weight adjustment process brings the actual output closer and closer to the desired output. In terms of transforming voice, actual samples of the intended person's voice are processed up to the neural network input. A speaker then repeats the same words spoken by the intended person and the speaker's samples are processed through the neural network. The neural network is then trained by comparing the neural network output from the speaker's sample with the intended person's sample. Once the network is so trained, other words from the speaker which are processed through the system 30 will sound like the intended person's voice.

The transformed harmonic band energy data from the network 60 is coupled along with the interpolated energy data and the interpolated voiced/unvoiced identifiers from interpolator 54 to the voiced/unvoiced band controller section 70.

In controller 70, the transformed harmonic band energy data are analyzed to determine which bands should be either voiced or unvoiced. The interpolated and transformed energy levels for each of the predetermined bands is compared and the corresponding identifier is modified accordingly. If the transformation substantially raised the energy level, by more than a predetermined threshold level, a one (1) is added to the identifier. If the transformation substantially lowered the energy level, by more than a predetermined threshold level, a minus one (−1) is added to the identifier. Lastly, if the transformation did not substantially change the energy level, by more than either threshold level, a zero (0) is added to the identifier. By this method, when an energy level goes up substantially it is assumed that structured, voiced energy has been transferred to that band and the voiced condition thereof is assured thereby. Likewise an energy drop is indicative of structured energy being transferred out of a band, so the unvoiced state is assured. Lastly, small changes are provided with continuity of the voiced/unvoiced state. The identifiers so modified may still be distinguished based upon the use of a threshold level such as 0.5.

Because the transformed band energies and modified identifiers have been expanded to the predetermined number of forty-eight bands, this data must be decimated to the proper harmonic bands corresponding to the mapped pitch of the second talker in order to accurately reconstitute the voice signal. For this purpose decimator 72 receives the mapped pitch data, the interpolated and modified identifiers and the transformed energy data and performs an inverse interpolation of the energies and identifiers to fill the harmonic bands of the mapped pitch data.

The decimated energy data and identifiers and the mapped pitch data are then coupled to the synthesis section 36 which reconstitutes the voice signal in much the same manner as the MBE vocoder of FIG. 1. The resulting voice signal is the voice of the talker having the pitch and vocal characteristics of the target.

The embodiments described above are intended to be taken in an illustrative and not a limiting sense. Various modifications and changes may be made to the above embodiments by persons skilled in the art without departing from the scope of the present invention as defined in the appended claims.

What is claimed is:

1. An apparatus for transforming a voice signal of a talker into a voice signal having characteristics of a different person, comprising:

means for separating a voice signal of someone such as a talker into a plurality of voice parameters including frequency components;

neural network means for transforming at least some of the separated frequency components from having characteristics of the talker into having characteristics of the different person; and means for combining the voice parameters after transformation of some of the frequency components by the neural network means, for reconstituting the talker's voice signal having characteristics of the different person.

2. The apparatus of claim 1, wherein the means for separating includes means for extracting pitch data and the frequency components of harmonic band energy data related to the pitch, and further wherein the neural network means transforms the extracted harmonic band energy data into harmonic band energy data having characteristics of the different person.

3. The apparatus of claim 2, further comprising means for mapping the pitch of the talker to the pitch of the different person.

4. The apparatus of claim 3, further comprising means for interpolating the extracted harmonic band energy data into a predetermined number of frequency bands prior to transformation by the neural network means.

5. The apparatus of claim 4, further comprising:

first means for determining a voiced/unvoiced identifier for each extracted harmonic energy band;

second means for determining a voiced/unvoiced identifier for each interpolated frequency band in response to the identifiers determined for the extracted harmonic energy bands; and means for modifying the voiced/unvoiced identifiers of the interpolated frequency bands in response to the transformed energy data and the interpolated energy data for use with the transformed energy data in the means for combining.

6. The apparatus of claim 5, wherein the means for modifying includes:

third means for determining the difference between the interpolated energy data and the transformed energy data for each of the predetermined number of frequency bands; and means for changing the voiced/unvoiced identifier for each interpolated frequency band in response to the difference between the interpolated energy data and the transformed energy data for the respective band and including means for assuring a voiced identifier for each frequency band for which the transformed energy data is substantially higher than the interpolated energy data, means for assuring an unvoiced identifier for each frequency band for which the transformed energy data is substantially lower than the interpolated energy data, and means for leaving the voiced/unvoiced identifier unchanged for each frequency band for which the transformed energy data is not substantially different from the interpolated energy data.

7. The apparatus of claim 6, wherein the means for combining includes means for modulating the transformed frequency band energy data with the mapped pitch for reconstructing the voice signal of the talker having characteristics of the voice of the different person.

8. The apparatus of claim 7, wherein the means for extracting includes means for determining the frequency distribution of the pitch of voice signals coupled thereto, and further comprising:

first means for separately storing the pitch data extracted from each voice signal coupled through the means for extracting;

second means for separately storing the interpolated frequency band energy data extracted for each voice signal coupled through the means for extracting;

means for separately coupling comparable voice signals of the talker and the different person pronouncing the same words through the means for extracting and the means for interpolating; and means for training the neural network means to transform the interpolated frequency band energy data of the talker into the interpolated frequency band energy data of the different person using the stored interpolated frequency band energy data of the comparable voice signals.

9. The apparatus of claim 7, wherein the means for combining further includes means for decimating the modulated energy data of the predetermined number of frequency bands into harmonic band energy data corresponding to the mapped pitch of the different person.

10. The apparatus of claim 9, wherein the means for extracting includes:

means for digitally sampling a voice signal;

means for converting the digitized voice signal into the frequency domain for discrete intervals thereof; and means for determining from the frequency domain signal of each interval a pitch frequency and frequency components.

11. The apparatus of claim 10, wherein the means for converting includes means for performing a process of either Fourier transform or linear predictive coding.

12. The apparatus of claim 11, wherein the means for modulating further includes second means for converting frequency domain signal data into the time domain.

13. The apparatus of claim 12, wherein the second means for converting includes means for performing the inverse process of either Fourier transform or linear predictive coding.

14. The apparatus of claim 3, wherein the means for extracting determines the mean frequency of the pitch frequency distribution and a standard deviation thereof.

15. The apparatus of claim 6, wherein the neural network means is a back propagation trained, recurrent neural network.

16. The apparatus of claim 14, wherein the means for mapping determines the number of standard deviations from the talker's pitch for specific voice samples and maps each specific sample to the same number of standard deviations from the different person's mean pitch.

17. An apparatus for transforming a voice signal of a talker into a voice signal having characteristics of a different person, comprising:

means for extracting pitch and frequency components from a voice signal of a talker;

means for mapping the pitch of the talker to a known pitch of the different person;

means for interpolating the extracted frequency components into a predetermined number of frequency bands;

neural network means for transforming interpolated frequency components from those of the talker to those having characteristics of the different person;

means for determining voiced and unvoiced identifiers for each of the predetermined number of interpolated frequency bands;

means for modifying the identifiers in response to the interpolated and transformed frequency components; and means responsive to the modified identifiers for modulating the transformed frequency components with the mapped pitch for reconstructing the voice signal of the talker having characteristics of the voice of the different person.

* * * * *